United States Patent [19]

Scull et al.

[11] 4,214,709

[45] Jul. 29, 1980

[54] ELECTROSTATIC SPRAY COATING APPARATUS

[75] Inventors: Jon V. Scull, Longmont, Colo.; Patrick D. Shaffer, Prospect Heights, Ill.

[73] Assignee: Binks Manufacturing Company, Franklin Park, Ill.

[21] Appl. No.: 18,567

[22] Filed: Mar. 8, 1979

Related U.S. Application Data

[63] Continuation of Ser. No. 837,418, Sep. 28, 1977, abandoned.

[51] Int. Cl.[2] ..... B05B 5/00

[52] U.S. Cl. ..... 239/707; 239/705

[58] Field of Search ..... 239/3, 690–708

[56] References Cited

U.S. PATENT DOCUMENTS

| | | | |
|---|---|---|---|
| 3,583,632 | 6/1971 | Shaffer | 239/705 |
| 3,747,850 | 7/1973 | Hastings et al. | 239/707 |
| 3,815,820 | 6/1974 | Probst | 239/707 |

*Primary Examiner*—Robert W. Saifer

*Attorney, Agent, or Firm*—Gary, Juettner & Pyle

[57] ABSTRACT

An electrostatic spray coating apparatus including means for mechanically atomizing coating materials and means for electrostatically charging the atomized material for deposit onto articles, is characterized by an improved material-charging means and an improved means for sealing material passages from the remainder of the apparatus in a manner which contributes to efficient and effective charging of the material, yet minimizes the capacitance of the material charging means, whereby the energy capable of being stored by the charging means is significantly reduced. The spray coating apparatus also includes means ensuring safety of the apparatus, and enhanced overall construction of the apparatus for greater service life, more reliable and safe operation, and economy.

13 Claims, 3 Drawing Figures

ELECTROSTATIC SPRAY COATING APPARATUS

This application is a continuation of application Ser. No. 837,418, filed Sept. 28, 1977, and now abandoned.

BACKGROUND OF THE INVENTION

The present invention relates to electrostatic spray coating apparatus, and in particular to an improved electrostatic spray coating apparatus having a material charging portion of significantly reduced capacitance and electrical energy storage capability.

Manual and automatic spray guns for mechanical atomization and electrostatic deposition of coating materials such as paint, lacquer, varnish and the like are known from such previously issued U.S. Patents such as U.S. Pat. Nos. 2,805,642; 3,048,498; 3,169,882; 3,169,883; 3,251,551; 3,253,782; 3,268,171; 3,583,632; and 3,737,099; etc. In general, the material is atomized from a nozzle by impinging streams of air on a stream of the material (air atomization), or by forcing the material through an appropriately shaped nozzle under adequate hydraulic pressure (hydrostatic atomization). Atomization may also be effected by centrifugal force and by electrostatic forces. As the coating material is atomized, an electrostatic charge is imparted to the material which causes the charged particles of atomized material to be attracted to work pieces or articles which are purposely grounded, whereby to cause most of the material to be deposited on the work.

The means for imparting an electrostatic charge to the material customarily includes a conductive charging electrode extending forwardly of the spray gun into the area in which atomization of the material occurs. Since a relatively high voltage at the electrode is used to impart the electrostatic charge, safety means ordinarily are provided to limit the voltage at the electrode should an operator of the gun come in contact therewith. Such a means may include a resistor connected in series between the charging electrode and a power supply for the gun. Should an operator of the gun come into physical contact with the electrode, the resistor limits the current which may be supplied to the electrode, thereby affording a measure of safety to the operator.

Despite the current limiting effects of such resistors, it nevertheless is possible under certain circumstances for a significant electrical charge to accumulate in the material charging portion of the spray gun. If, for example, the charging electrode of the gun is held in noncontacting proximity with an electrically conductive body, as a result of a corona generated about the charging electrode a charge will be accumulated on the body and may result in the discharge of an electrical arc between the body and the nozzle of the gun. Should such an arc occur in an explosive atmosphere, as may be created by an atomized mixture of certain coating materials in air, an explosion may result. Consequently, to minimize the possibility of the occurrence of such an electrical discharge or arc, the material charging portion of the spray gun desirably should exhibit minimum capacitance or minimum electrical energy storage capability.

OBJECTS OF THE INVENTION

A primary object of this invention is to provide an electrostatic spray coating apparatus having an improved coating material charging means which is of minimum capacitance and energy storage capability.

Another object is to provide optimum safety in use and operation of electrostatic spray guns.

A further object is to provide an improved spray gun of greater reliability and serviceability.

SUMMARY OF THE INVENTION

In accordance with the present invention, an improved electrostatic spray apparatus has an electrically insulating body including a material passage terminating in an outlet orifice, and a valve for opening and closing the orifice, which includes an electrically insulating stem extending thrugh the passage. Electrically conductive material charging means are provided on one end of the stem extending to and through the orifice without sealing the stem to the body, and a power lead is connected to the charging means for causing the charging means to charge material passing through the passage and the orifice. The conductive means is the sole electrically charged means contacted by the material, and has a relatively low capacitance or energy storage capability.

Preferably, means are connected with an opposite end of the stem for moving the stem in the passage to open and to close the valve, and means are provided for sealing the moving means from the passage. The sealing means comprises a metal bellows fixed at one end to the opposite end of the stem, and at its other end to the moving means, and the metal bellows is electrically insulated from the electrically conductive charging means and forms no part of the capacitance of the charging means. The charging means comprises a charging needle detachably secured to the stem and extending through the orifice, or may comprise a combined charging needle and valve member detachably secured to the stem and adapted to be replaced to accommodate variation in valve characteristics and in the event of damage to the charging needle.

By virtue of the charging means providing the sole capacitance in the material charging circuit, and the metal bellows being electrically isolated therefrom, the energy storage capability of the apparatus is significantly reduced, thereby decreasing the likelihood of arcing between the apparatus and a surrounding conductive body, and providing an electrostatic spray apparatus of improved safety and reliability.

The foregoing and other objects, advantages and features of the invention will become apparent from a consideration of the following detailed description, when taken in conjunction with the accompanying drawings.

DETAILED DESCRIPTION

Figure 1:
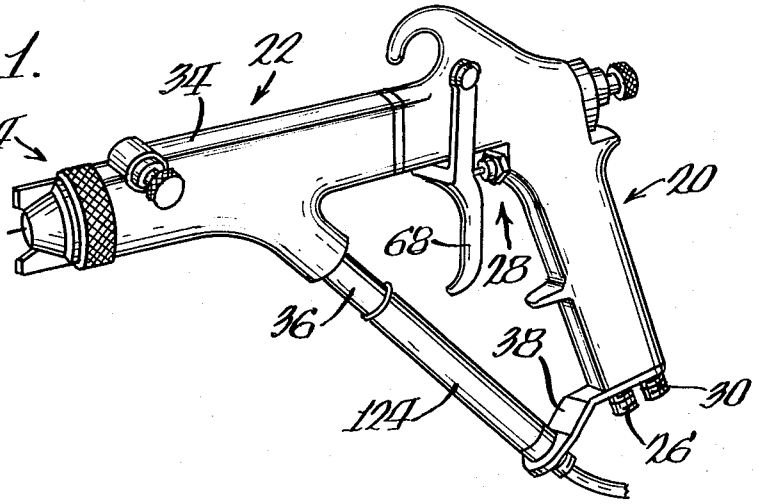
FIG. 1 is a perspective view of a manually operated, air atomizing, hand spray gun embodying the present invention.
Figure 2:
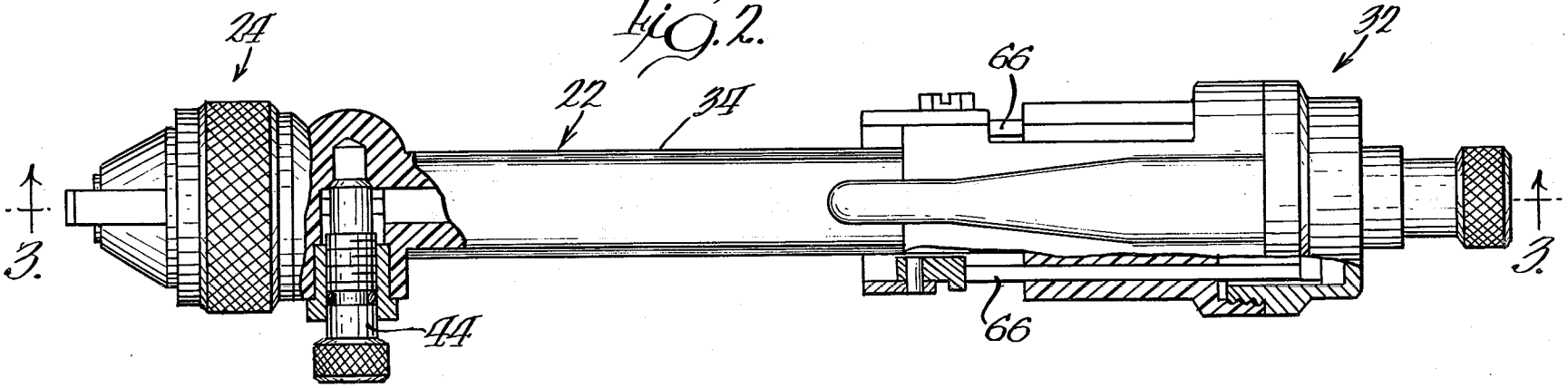
FIG. 2 is a top plan view, partly in cross-section, illustrating the arrangement of a valve for controlling the application of "fan" air to the discharge end of the gun.
Figure 3:
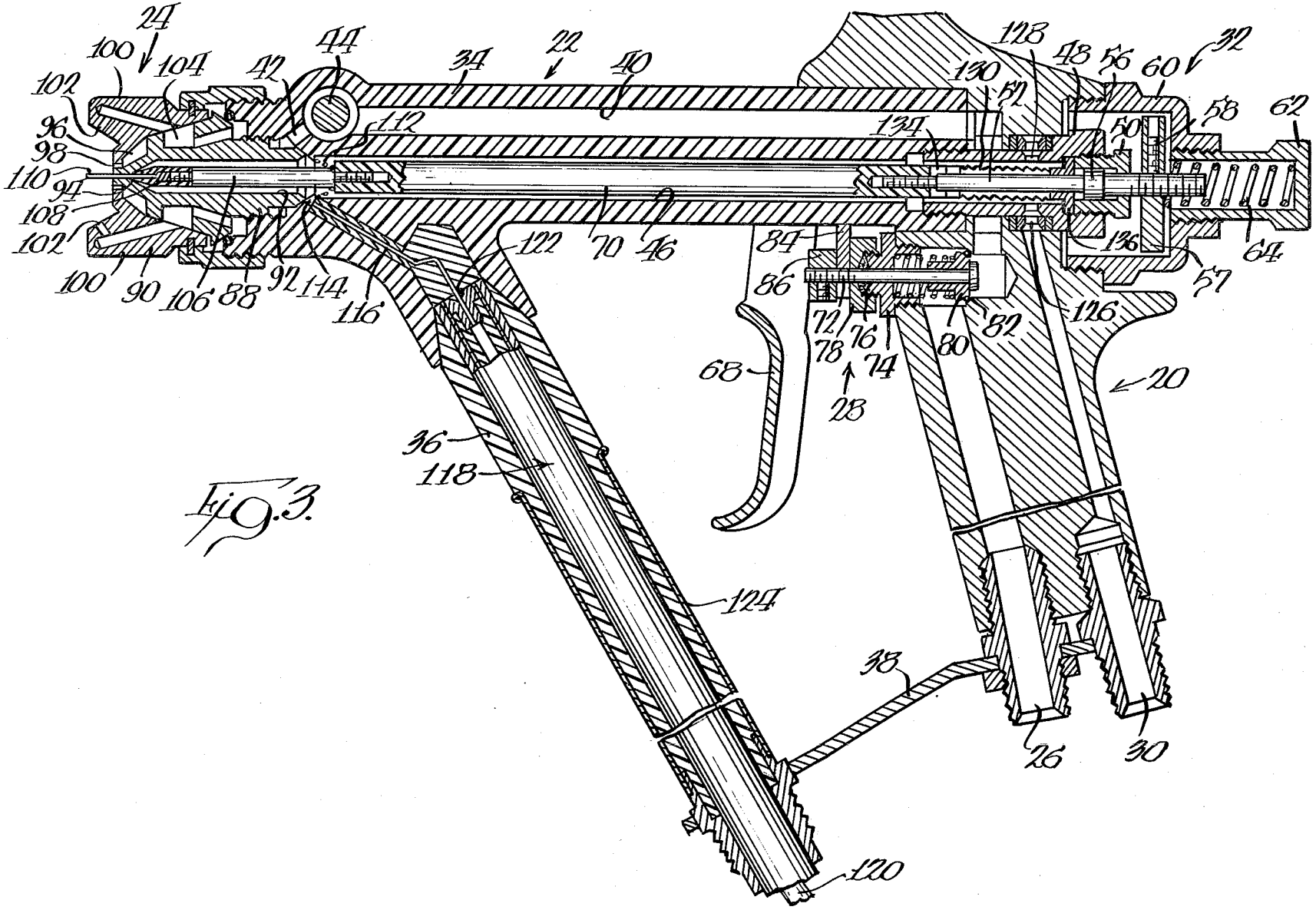
FIG. 3 is a vertical longitudinal section of the gun taken on an enlarged scale, illustrating the material charging portion of the gun having the reduced capacitance and reduced electrical energy storage capability in accordance with the invention.

The hand gun of FIGS. 1 through 3 is comprised of a conductive handle portion 20, an insulating barrel portion 22, and an insulating nozzle assembly 24.

The handle 20 is formed of metal and includes an air inlet 26, an air valve 28, a material inlet 30, and a material valve 32.

The barrel 22 is formed of insulating material, and includes a main body 34 and a tube 36 inclined downwardly and rearwardly from the body for reception of a charging conductor. The lower end of the tube is joined with the air and material inlets 26 and 30 by a bracket 38, and by virtue of the downward and rearward inclination of the tube, the inlets for the material and air hoses, and the inlet for the charging conductor, are disposed adjacent one another to accommodate a neat and easily handled assembly of flexible conduits leading to the gun, which can be easily controlled and manipulated by the gun operator.

As shown in FIG. 3, the barrel has a longitudinal air passage 40 communicating with the air passage in the handle, to which air is supplied under control of the valve 28. At the forward end of the body, a pair of air ports communicate with the passage, namely, a port (not shown) for supply of atomizing air and a port 42 for supply of fan air. The latter port is under the control of a valve 44, which comprises a headed insulating material screw threaded into the body 34 and adjustable therein to control the area of the opening between the passage 40 and the port 42.

The barrel body 34 also includes an axially extending passage 46 aligned with and receiving the material control valve 32. The valve 32 is of conductive material and includes a screw 48 extended through the handle 20 and threaded into a counterbore in the rearward end of the barrel body 34, and a cap 50 threaded into the screw 48. A conductive stem 52 slidably extends through the cap 50, and has an enlarged portion 56 received within the cap. A disc 57 is positioned on a rearward extension of the stem, and is secured to the stem by a set screw 58. A cap 60 threaded into a counterbore in the handle encloses the major portion of the material valve, an adjusting screw 62 is threaded into the rearward end of the cap, and a spring 64 is maintained under compression between the end of the adjusting screw and the disc 57.

To actuate the valve, a pair of rods 66 extend between a pivotally mounted trigger 68 and the disc 57, whereby movement of the trigger toward the handle engages the disc 57 with ends of the rods to move the stem 52 rearwardly. Immediately within the passage 46, the stem 52 is terminated and an insulating stem 70 is threaded thereto, the stem 70 extending forwardly within the passage 46 to adjacent the front end of the barrel and constrained for movement with the stem 52.

The air valve 28 is formed of conductive material and includes a stem 72 extending rearwardly through a nut 74, packing 76, and a packing nut 78 to a valve member 80 adapted to form a seal with a valve seat 82 formed in the air passage through the handle. Upon actuation of the trigger, a reverse motion mechanism (not shown) moves an arm 84 forward and against a collar 86 secured to a forward end of the stem 72 to open the air passage through the handle. This connects the air inlet 26 in the handle with the air passage 40 through the barrel.

The nozzle assembly 24, which is formed entirely of insulating material, comprises a material nozzle 88 and an air nozzle 90, both threadably attached to the front end of the barrel body 34 in axial alignment with the passage 46, in the manner conventional in the art.

The material nozzle 88 is threaded into a counterbore in the forward end of the body 34, and includes an axial bore 92 aligned with the passage 46 and comprising a port for paint or coating material. At its forward end, the bore is necked down to form a conical valve seat 94 (on which the material valve seats) and a small diameter outlet for discharge of a solid stream or jet of coating material. Radially outward of the bore 92, the material nozzle includes second longitudinally extending port means (not shown which communicates with the passage 40 in the body upstream from the valve 44 and conducts air into a chamber 96 defined between the material nozzle and the air nozzle. At its center, the air nozzle is formed to define port means, here shown as an annular opening 98 surrounding the material outlet, for impinging air onto the discharging stream of coating material to atomize the material into small discrete particles.

The atomized spray of paint or other coating material, absent further control thereover, would issue from the nozzle in the form of a gradually expanding conically shaped spray, and would be deposited on the work in a circular pattern. If such pattern is desired, the valve 44 is adjusted to close the connection between the passage 40 and the port 42. Usually, however, it is desired to convert the conical spray into a fan-shaped spray so as to deposit coating material on the work in a rectangular or elliptical pattern. For this purpose, the air nozzle 90 includes a pair of opposed ears 100 provided with ports 102 for impinging streams of air onto opposite sides of the atomized spray, whereby to force the spray into a flat or fan-shaped pattern. Air is supplied to the ports 102 in the ears 100 through holes in the air nozzle and radially outer ports 104 in the material nozzle 88 which communicate with the port 42 in the barrel body. The amount of air admitted to the ports 102, and thus the degree of fanning or shaping of the spray pattern, is determined by the valve 44.

To impart an electrostatic charge to the material sprayed from the gun, a conductive extension 106 is threaded to the forward end of the insulated stem 70 of the material valve, and to this is threadedly attached a conductive valve and charging needle member 108. The member 108 comprises a conical portion mated to the conical seat 94 of the material nozzle, and adapted to seat thereon to close the material outlet from the gun, the valve normally being engaged with its seat under the bias of the spring 64 in the valve 32. Projecting forwardly from the valve portion of the member 108 is a small diameter, preferably pointed, charging needle 110, which projects from the seat through and forwardly of the material outlet into the area where the material is atomized into a spray. The member 108 is detachably mounted on the valve stem 70–106 to facilitate ready replacement of the member 108 for two purposes, namely (1) to replace the member when the charging needle 110 becomes badly bent or is broken off due to mishandling of the gun, and (2) to accommodate selective exchange of members having different valving characteristics.

To provide a charging voltage to the conductive valve and charging needle member 108, a conical spring 112 is captured at its narrow end between the conductive extension 106 and the forward end of the insulating stem 70, and is maintained under compression with its wide end abutting against a radial shoulder 114 in the passage 46 at the forward end of the barrel. A conductor 116 is potted within a rearwardly and downwardly inclined passage in the barrel body 34, and extends to the tube 36, the conductor at its upper end electrically contacting the spring 112.

The tube 36 is physically united to the barrel body by a process called "spin-welding". Specifically, the tube and the body are formed of thermosetting materials, and the tube and the bore in the body have mating conical end portions. The tube is inserted in the bore and then rotated therein at sufficient speed and under sufficient compressive force to develop friction heating of the mating surfaces of the material to a temperature at or slightly in excess of their melting temperatures, whereupon the rotation is stopped and the mating surfaces become integrally fused. In this manner, a structurally solid bond of insulating integrity is attained between the body 34 and the tube 36.

The tube 36 is adapted for close tolerance and form fitting reception therein of a rigid probe 118 mounted on the end of a high voltage conductor 120 for carrying a high voltage charge to the gun. The conductor, which is flexible, comprises a coaxial cable which is appropriately shielded and insulated. The probe 118 includes a resistor element (not shown) therein, one side of which is connected with the conductor 120 and the other side of which is connected with the conductor 116. The resistor element thus is in series with the conductors 116 and 120, or interposed therebetween, whereby the charging voltage applied to the conductor 116 from the conductor 120, and thence to the charging means 106, 108 and 112 must first pass through the resistor element.

The particular virtue of the probe assembly is that a workman cannot possibly become exposed to or have direct engagement with the high tension conductor 120. If the resistor is in place, the individual is separated from the high tension cable by the safety factor of the limiting resistor.

As above indicated, the probe 118 is slidably insertable into and removable from the tube 36 in form fitting relation therewith. As the probe is inserted into the tube, a conical fitting 122 on the outer end thereof guides the terminal portion of the conductor wire 116 into electrical contact with the probe resistor, whereby to establish a conductive path from the conductor 120, through the resistor, to the conductor 116, the spring 112, the conductive extension 106, and the conductive valve and charging needle 108. In this conductive path, there are no air gaps, exposed sharp corners or other impediments that might give rise to a dielectric breakdown, corona discharge or the like. Nevertheless, to ensure complete safety, the tube is encased, over the critical portion thereof, with a grounding shield 124 for protection of the operator.

According to the present invention, the only conductive material in the nozzle of the gun, which comprises the material charging means thereof, is the extension 106, the valve and charging needle 108, and the spring 112.

These components have a limited and relatively small surface area, and therefore provide only a small capacitance or electrical energy storage capability in the nozzle. This arrangement differs significantly from conventional electrostatic spray guns, in which a metal bellows is positioned in the nozzle to provide a seal between the material passage in the material nozzle and the passage in the insulating body which accommodates the insulating stem, and which forms a part of the material charging means. Since the bellows has a relatively large surface area, when made a part of the charging circuit the capacitance of the charging circuit is significantly increased, thereby increasing the possibility of an electrical arc being developed between the nozzle of the gun and a conductive body in close proximity therewith.

To accommodate removal of the metal bellows from the material charging circuit to significantly reduce the capacitance or electrical energy storage capability thereof, in the apparatus of the invention the coating material is supplied to the gun through the handle 20, and enters the barrel body 34 at the rearward end thereof for passage forwardly of the body to and through the material nozzle 88. For this purpose, the material inlet 30 communicates with an annular passage 126 formed about the screw 48, and therefrom with the interior of the screw through a plurality of radial ports 128 circumferentially formed therethrough. From the interior of the screw, a path is established for a flow of the material to the outlet from the gun through the body passage 46 and around the insulating stem 70, and through the material nozzle bore 92 and around the conductive extension 106 and the valve 108, whereby material provided at the inlet 30 flows through the handle 20 of the gun, the barrel 22 and the nozzle 24 to the outlet in the nozzle.

To seal the material valve 32 against passage of material rearwardly therethrough, an expandable and contractable metallic bellows 130 encircles the forward end of the conductive stem 52 at and to the point whereat the stem enters the cap 50. The bellows includes an integral fitting 134 at its forward end which is sealingly clamped between the forward end of the conductive stem 52 and the rearward end of the insulating stem 70, and an integral fitting 136 at its rearward end which is sealingly secured against a radial shoulder in the screw 48 by the cap 50. The bellows is expandable to accommodate forward movement of the material valve to engage the needle valve member 108 with its seat 94 under the bias of the valve spring 64 in the handle to close the material outlet from the gun, and is contractable to accommodate rearward movement of the needle valve upon actuation of the trigger 68 to open the outlet and accommodate discharge of coating material.

The bellows is formed of conductive metal, whereby it provides an excellent of seal of long and effective service life. Bellows formed of materials other than metal are generally unsuitable in spray coating apparatus, since the same often are adversely affected by coating materials, and under the usage and operating conditions encountered in spray coating apparatus have a relatively short service life. Consequently, such bellows when used in spray coating apparatus desirably are of a metallic material.

With conventional electrostatic spray coating apparatus, the coating material generally is supplied to the gun body immediately to the rear of the material nozzle, and a metal bellows is employed at the forward end of the gun to prevent passage of the material rearwardly through the passage accommodating the insulating valve stem member. Under these circumstances, the bellows itself constitutes part of the electrostatic charging means of the gun or, if not, is at least capable of accumulating a charge thereon. The bellows has a relatively large surface area, and as a result, in combination with the other conductive members in the nozzle of the gun, provides a significant capacitance or energy storage capability at the forward end of the gun. As a result, if in operating the gun the charging electrode is positioned close to but not in contact with a conductive body, an arc or electric spark may occur between the body and the gun. Should an arc occur in an explosive atmosphere, as may be created by an atomized mixture of certain types of coating materials and air, a damaging explosion may occur.

By positioning the metallic bellows at the rearward end of the gun in accordance with the teachings of the present invention, rather than in the nozzle area thereof as is conventional, the capacitance or energy storage capability in the nozzle of the gun is significantly reduced. The bellows is grounded to the handle of the gun, and therefore cannot possibly provide capacitance for the nozzle thereof. The only conductive members in the nozzle of the gun are the spring 112, the conductive extension 106 and the conductive valve and charging needle 108, which together provide only a relatively low capacitance in the nozzle, significantly less than is conventional. In consequence, should the gun be operated with the nozzle in noncontacting proximity with a metallic body, the likelihood of an electrical discharge occurring therebetween is eliminated or at least greatly reduced.

In the operation of the spray gun, upon actuation of the trigger 68 the air valve member 80 is moved from its seat 82 to establish a passage for a flow of air from the air inlet 26 to the annular air atomizing opening 98 and the opposed fan shaping ports 102, with the valve 44 controlling the flow of air from the ports 102 and therefore the shape or flatness of the material sprayed from the gun. The rods 66 are of a length to terminate before the disc 56 when the trigger is in its unactuated position, whereby upon actuation of the trigger motion is lost to open the air passage prior to engagement of the disc with the ends of the rods, so that a flow of air is established at the nozzle of the gun prior to a flow of material therefrom. With continued actuation of the trigger, the rods then engage and move the disc, and therethrough the conductive stem 52, the insulating stem 70, the conductive extension 106 and the conductive valve and charging needle 108 rearwardly, to move the valve 108 from its seat and to establish a flow of material through the outlet from the gun. To control the rate of material flow from the gun, the adjusting screw 62 is threadable into or out of the cap 60 to limit the rearward travel of the disc 56, and therefore the distance which the valve 108 may move from its seat 94.

As is appreciated, the electrostatic coating material charging components of the gun consist only of the spring 112, the conductive extension 106, and the conductive valve 108 with its charging needle 110, which have relatively small and limited surface areas so that the capacitance or electrical energy storage capability in the nozzle of the gun is quite low. These members are directly coupled to the high tension conductor 116, and are otherwise widely insulated from the remaining metal components of the gun, which remaining metal components are connected with a source of ground in the operation of the gun to prevent an electric charge from accumulating either thereon or on an operator of the gun. Paint entering and passing through the gun via the passage 46 contacts the conductive components in the nozzle 24, whereby essentially all of the discrete particles of the spray are efficiently and effectively charged to high electrostatic potential for efficient deposition on a grounded article of work.

At the same time, the operator is afforded optimum safety by virtue of electrical grounding of all components with which he may come in contact. Specifically, the gun handle 20, the grounding shield 124, and the material supply hose are commonly grounded via a grounding sheath of the cable 120 by means of the conductive bracket 38 interconnecting conductive inlet fittings on the air inlet 26, the material inlet 30 and the inlet to the tube 36, the latter of which receives and becomes electrically connected by the grounding sheath on the power supply cable 120. In this manner also, the gun operator is grounded through the gun handle, whereby he does not and cannot become a capacitive influence in the electrostatic system.

The invention thus provides an extremely useful and highly efficient electrostatic hand spray gun of great safety, long service life, light weight, convenient handling, and aesthetically pleasing design.

While one embodiment of the invention has been described in detail, various modifications and other embodiments thereof may be devised by one skilled in the art without departing from the spirit and scope of the invention, as defined by the appended claims.

What is claimed is:

1. An electrostatic spray apparatus having an electrically insulating body including a material passage terminating in an outlet orifice, and a valve for opening and closing said orifice including an electrically insulating stem extending through said material passage, the improvement comprising electrically conductive material charging means on one end of said stem extending to and through said orifice without sealing said stem from said material passage, so that upon occurrence of material in said passage said stem is exposed to and contacts the material, and a power lead connected to said conductive means for causing said conductive means to charge material passing through said passage and said orifice, said conductive means being the sole electrically charged means contacted by said material and having a low capacitance or electrical energy storage capability.

2. An apparatus as in claim 1, including means connected with an opposite end of said stem for moving said stem in said passage to open and close said valve, and means for sealing said moving means from said passage.

3. An apparatus as in claim 2, said scaling means comprising a metal bellows fixed at one end to said opposite end of said stem and at its other end to said moving means, said metal bellows being electrically insulated from said material charging means and forming no part of the capacitance of said charging means.

4. An apparatus as in claim 1, said charging means comprising a charging needle detachably secured to said stem and extending through said orifice.

5. An apparatus as in claim 1, said charging means comprising a combined charging needle and valve member detachably secured to said stem and adapted to be replaced to accommodate variation in valve characteristics and in the event of damage to the charging needle.

6. An electrostatic spray apparatus having an electrically insulating body including a material passage terminating at a forward end thereof in an outlet orifice, a valve for opening and closing said orifice including an electrically insulating stem extending through said passage, and means connected with said stem at a rearward end of said passage for moving said stem in said passage to open and close said valve, the improvement comprising a material inlet communicating with said passage at said rearward end thereof, a bellows in said passage and fixed at one of its ends to said moving means and at the other of its ends to said insulating stem for sealing said moving means from said passage, and an electrostatic material charging circuit comprising electrically conductive stem means connected with said insulating stem at the forward end of the passage and extending to and through said orifice, said electrically conductive stem means being electrically insulated from said bellows, and means for carrying a high electrostatic charge solely to said conductive stem means to charge material passing from said inlet through said outlet.

7. An electrostatic spray apparatus as in claim 6, said bellows being a metal bellows, said metal bellows forming no part of the capacitance of said electrostatic charging circuit.

8. An electrostatic spray apparatus having an electrically insulated body including a material passage terminating in an outlet orifice, a valve for opening and closing said orifice including an electrically insulating stem through said passage, and an electrically conductive normally grounded stem operating section mounted on said body at the end thereof remote from said orifice, said stem operating section including a conductive portion connected with the end of said insulating stem thereat, the improvement comprising material inlet means at the remote end of said body in communication with said passage thereat, means for sealing said stem operating section from the material, an electrostatic charging circuit including a charging needle connected with said insulating stem at an opposite end thereof and extending to and through said orifice, and means for carrying a high electrostatic charge to said charging needle to charge material passing from said inlet means through said outlet, said body and stem being elongate and said body and stem being formed of high dielectric material for electrically isolating said charging needle from said grounded stem operating section.

9. An electrostatic spray apparatus as in claim 8, said sealing means comprising a metal bellows around a conductive portion of said stem operating section and connected at one of its ends with said insulating stem at the other of its ends with said stem operating section, said insulating body and stem electrically isolating said bellows from said charging needle, whereby said bellows forms no part of said electrostatic charging circuit and contributes no capacitance thereto.

10. An electrostatic spray apparatus comprising an electrically conductive normally grounded handle including a material valve and a valve operating trigger, an electrically insulating barrel and an electrically insulating valve stem in a passage through said barrel projecting forwardly from the upper end of said handle and trigger, said valve stem connected with said material valve, an electrically insulating nozzle assembly on the forward end of said barrel and having a passage communicating with said barrel passage and a material outlet at an end of said passage, a material inlet in said handle and communicating with said barrel passage, an electrostatic charging circuit including conductive elements in said nozzle passage and connected with said insulating valve stem, means for sealing said material valve from the material, and means for carrying high electrostatic charge to said conductive elements in said nozzle to charge material passing from said material inlet to said outlet, said insulating barrel and stem electrically isolating said conductive elements from said handle, material valve and valve operating trigger.

11. An electrostatic spray apparatus as in claim 10, said sealing means comprising a metal bellows connected at one end between said insulating stem and at its other end with said material valve, said insulating barrel and stem electrically isolating said metal bellows from said conductive elements whereby said bellows forms no part of the material charging circuit and contributes no capacitance thereto.

12. An electrostatic spray apparatus as in claim 10, said nozzle defining a valve seat in said passage thereof adjacent said outlet, said conductive elements including an elongate stem extending to and through said outlet, said elongate stem having a valve portion adapted to engage and form a seal with said valve seat to control a flow of material through said outlet.

13. An electrostatic spray apparatus having an electrically insulating body including a material passage terminating in an outlet orifice, and a valve for opening and closing said orifice including an electrically insulating stem extending through said material passage, the improvement comprising electrically conductive material charging means on one end of said stem extending to and through said orifice without sealing said stem from said material passage, so that upon occurrence of material in said passage said stem is exposed to and contacts the material, a power lead connected to said conductive means for causing said conductive means to charge material passing through said passage and said orifice, said conductive means being the sole electrically charged means contacted by said material and having a low capacitance or electrical energy storage capability, means connected with an opposite end of said stem for moving said stem in said passage to open and close said valve, and means for sealing said moving means from said passage, said sealing means comprising a bellows fixed at one end to said opposite end of said stem and at its other end to said moving means, said bellows being electrically insulated from said material charging means and forming no part of the capacitance of said charging means.

* * * * *